United States Patent [19]

Morris

[11] 3,934,425

[45] Jan. 27, 1976

[54] FLOODED REFRIGERANT CONDENSER HEAD PRESSURE CONTROL

[75] Inventor: Herman H. Morris, Chattanooga, Tenn.

[73] Assignee: Custom Mechanical Contractors, Inc., Chattanooga, Tenn.

[22] Filed: Sept. 5, 1974

[21] Appl. No.: 503,296

[52] U.S. Cl. ..... 62/117; 62/DIG. 17

[51] Int. Cl.[2] ..... F25B 49/00

[58] Field of Search ..... 62/196, 117, 509, DIG. 17

[56] References Cited

UNITED STATES PATENTS

| | | | |
|---|---|---|---|
| 1,533,336 | 4/1925 | Pownall | 62/196 X |
| 1,790,237 | 1/1931 | King | 62/196 X |
| 3,060,699 | 10/1962 | Tilney | 62/196 |

*Primary Examiner*—William E. Wayner

*Attorney, Agent, or Firm*—Hill, Gross, Simpson, Van Santen, Steadman, Chiara & Simpson

[57] ABSTRACT

A condenser head pressure control for a flooded refrigerant system of the vapor compression type has a valve chamber with three ports spaced axially, two leading to the top and bottom of a condenser and an inlet port leading to the system compressor. A piston valve in the valve chamber is controlled by a spring-biased diaphragm responsive to inlet port or system compressor output pressure. The valve connects the compressor outlet to the top of the condenser at low output pressures and to the bottom of the condenser at high pressures. A capillary tube connects the top of the condenser to the valve inlet. The control achieves substantially constant head pressure while avoiding any need for critical charging of the refrigerant system or variable speed controls or dampers on the condenser fan.

4 Claims, 3 Drawing Figures

Fig. 1
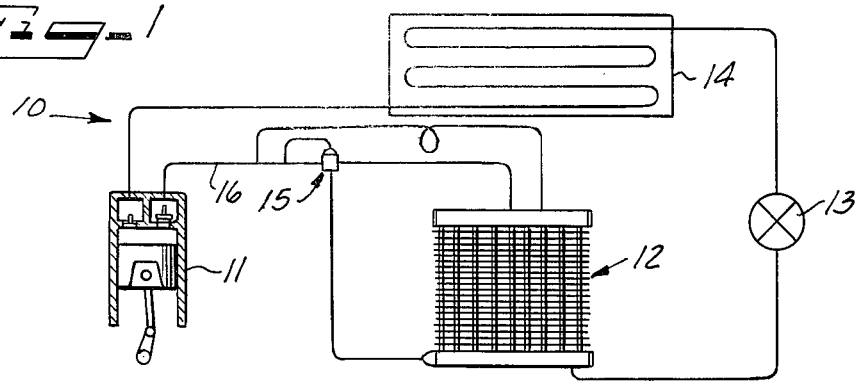
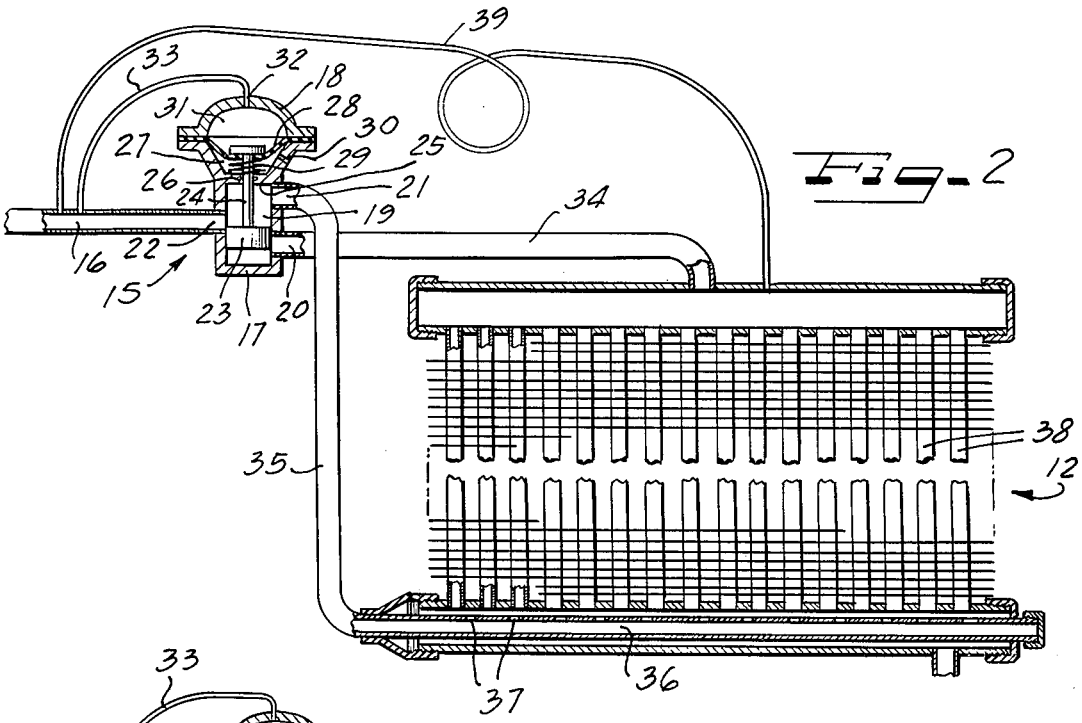
Fig. 2
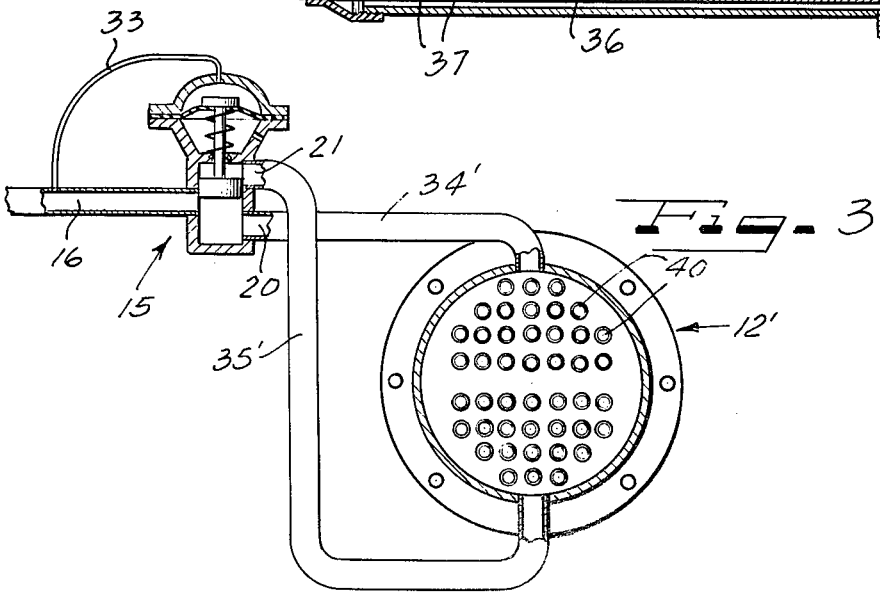
Fig. 3

FLOODED REFRIGERANT CONDENSER HEAD PRESSURE CONTROL

BACKGROUND OF THE INVENTION

1. Field of the Invention

This invention relates to control devices for mechanical refrigerating systems of the vapor compression type.

2. Description of the Prior Art

In prior art refrigeration systems of the vapor compression type, hot vapors are discharged from the compressor through a single line to the top or side of an air cooled condenser or to the top of a water cooled condenser. For such systems, the charging level of the refrigerant in the system may be critical and variable speed controls, face dampers, or cycling controls may be required on the condenser fans to maintain the system at optimum efficiency. My co-pending application, U.S. Ser. No. 449,734, filed Mar. 11, 1974, entitled "Flooder Refrigerant Condenser Systems", discloses a condenser where hot vapors are introduced into the bottom of the condenser to equalize condenser temperature and heat transfer across its entire surface.

SUMMARY OF THE INVENTION

In accordance with the principles of this invention, a control valve is provided with a cylindrical chamber having two outlet ports spaced axially therein and an inlet port located axially equidistantly between the two outlet ports. A piston movable axially in the valve chamber has a rod extending axially through a wall of the chamber and engaging a diaphragm within a pressure chamber which is exposed at one side to inlet port pressure and biased against said inlet port pressure by a spring. The inlet port of the device is connected with the discharge side of the system compressor. One outlet port is connected with the top of the system condenser, and the second port is connected with the bottom of the condenser. The rod and piston of the valve are structured in relation to the inlet and outlet ports and to the diaphragm to block communication between the inlet port and the second outlet port when the inlet vapor is at low pressure, and to block communication between the inlet port and the first outlet port, going to the top of the condenser, when there is high pressure in the inlet tube valve. A pressure-equalizing capillary tube is required between the inlet port of the control valve and the first outlet port in systems using an air-cooled condenser, but such pressure-equalizer is not needed where water cooling is employed.

BRIEF DESCRIPTION OF THE DRAWINGS

FIG. 1 shows partly in schematic form a mechanical refrigerating system employing the control valve of the present invention.

FIG. 2 shows the control valve and condenser in cut-away detailed section, using an air-cooled condenser and showing the system in its pressurized state.

FIG. 3 shows the control valve of the present invention employed with a water-cooled condenser, with the system unpressurized.

DESCRIPTION OF THE PREFERRED EMBODIMENT

FIG. 1 shows a basic single stage vapor compression refrigeration system employing five basic components, a compressor 11, a condenser 12, an expansion valve 13, an evaporator 14, and a control valve 15. As liquid refrigerant flows through the evaporator 14, heat is absorbed from the material being cooled and the refrigerant is boiled. The low pressure vapor from the evaporator 14 passes to compressor 11 and is compressed. The pressure and temperature levels of the refrigerant in compressor 11 are increased to a point where the resulting super-heated refrigerant vapor can be compressed by the cooling media available, shown in FIG. 1 as air about the condenser 12.

In compressing the refrigerant gas, heat of compression is added to the vapor as the pressure is raised. The vapor flows through the valve 15 to the condenser 12 where the gas is liquidified. The liquid refrigerant flows from the condenser 12 to the expansion valve 13 where its pressure and temperature are reduced to those in the evaporator 14, thus completing the cycle. Hot vapor will be directed from the control valve 15 to the top of the condenser 12 when pressure in the line 16 from the discharge of the compressor 11 is low, and will go to the bottom of the condenser 12 when pressure in the line 16 is high.

The control valve 15 comprises a valve portion 17 and a pressure control portion 18, as shown in FIG. 2. The valve portion 17 comprises a cylindrical chamber 19 having first and second outlet ports 20 and 21 spaced axially in the wall of the chamber 19, and one inlet port 22 communicating with the line 16 from the compressor 11 in the wall of the chamber 19 axially equidistant between the two outlet ports 20, 21. A piston 23 is movable axially within the chamber 19 selectively to connect either of the outlets 20, 21 with the inlet port 22.

Position of the piston 23 is controlled by a rod 24 connected thereto. The rod 24 extends through the top wall 25 of the valve portion 17 and is sealed against pressure leakage by an O-ring 26 secured in the wall 25. the rod 24 extends into an unpressurized portion 27 of the control portion 18 of the control valve 15 and is thereafter attached to the flexible diaphragm 28. The rod 24 and the diaphragm 28 are biased upwardly by a coil spring 29 which bears against the upper surface of the wall 25 dividing the valve portion 17 of the control valve from the control portion 18.

A vent 30 in a wall of the unpressurized chamber 27 prevents pressurization of the chamber 27 due either to motion of the diaphragm 28 or to leakage of vapor past the O-ring 26.

The diaphragm 28 seals the lower side of a pressurized chamber 31 of the control portion 18. An inlet 32 at the top of the control portion 18 communicates the pressure chamber 31 via a tube 33 with the conduit 16 from the compressor 11 to the inlet port 22.

The first outlet port 20 communicates with the upper part of the condenser 12 via a conduit 34. The second outlet port 21 communicates via a conduit 35 to a vapor line 36 in the bottom portion of the condenser 12. As is described more fully in my co-pending application for U.S. Pat., Ser. No. 449,734, the vapor tube 36 is perforated as at 37 to allow the rise of vapor bubbles into the conduits 38 of the condenser 12 in order to maintain the temperature of all parts of the condenser at a uniform level.

A capillary tube 39 is connected between the inlet port 22 and the outlet port 20 to insure that pressure may be equalized therebetween under conditions of high ambient air temperature which increases the pressure within the vapor discharged by the compressor 11.

The capillary tube prevents the liquid in the condenser from being returned by suction to the compressor discharge line 16 wherein imperfect sealing of the compressor valves or non-uniform temperature of the discharge pipe allows condensation of the refrigerant upstream of the condenser.

FIG. 3 shows use of the control valve 15 with a water-cooled condenser 12'. In this embodiment, the low pressure discharge conduit 34' from the control valve outlet 20 is connected to the top of the cooling chamber, while the high pressure conduit 35'from the second outlet port 21 is connected vertically to the bottom of the cooling chamber of the condenser 12', without use of the vapor tube 36. The refrigerant vapor is cooled by heat exchange with water carried in tubes 40 extending through the cooling area. No capillary tube pressure equalizer 39 is required in the water-cooled condenser application of the control valve 15 because ambient temperature of water in the tubes 40 generally does not allow the system to overheat.

Although various modifications might be suggested by those versed in the art, it should be understood that I wish to embody within the scope of the patent warranted hereon all such modifications as reasonably and properly come within the scope of my contribution to the art.

I claim as my invention:

1. In a condenser assembly for use in a mechanical refrigeration system of the vapor compression type and having a compressor with a discharge side and a condenser with top and bottom portions, a refrigerant condenser head pressure control comprising:

a pressure control housing;

a wall in said housing partitioning the interior thereof into a cylindrical valve portion and a control portion axially adjacent said valve portion;

the valve portion having two axially-spaced outlet ports and an inlet port spaced substantially axially equidistantly therebetween;

conduit means connecting said outlet ports with the top and bottom portions of the condenser;

the control portion having a flexible vapor-tight diaphragm sealing a pressurizable first portion from an unpressurizable second portion, said first portion having means for communicating with the inlet port of the valve portion, and said second portion containing means biasing said diaphragm against high pressure within said first portion; and a piston movable axially in said valve portion and connected by a piston rod through said chamber wall to said pressure control diaphragm to be moved thereby, said piston sealingly engaging the walls of said valve portion and in a first position blocking communication between a first one of said outlet ports and opening communication between said inlet port and a second of said outlet ports when the first portion of the control portion is pressized and in a second position blocking said second outlet portion and communicating said inlet with said first outlet port when the first portion of the control portion is not pressurized.

2. In a condenser assembly for use in a mechanical refrigeration system of the vapor compression type and having a compressor with a discharge side and a condenser with top and bottom portions, a refrigerant condenser head pressure control comprising:

a pressure control housing;

a wall in said housing partitioning the interior thereof into a cylindrical valve portion and a control portion axially adjacent said valve portion;

the valve portion having two axially-spaced outlet ports and an inlet port spaced substantially axially equidistantly therebetween, said inlet port accepting vapor from said discharge side of said mechanical compressor;

said second outlet port passing vapor to said upper condenser tank portion; and said first outlet port passing vapor to said lower condenser tank portion;

the control portion having a flexible vapor-tight diaphragm sealing a pressurizable first portion from an unpressurizable second portion, said first portion having means for communicating with the inlet port of the valve portion, and said second portion containing means biasing said diaphragm against high pressure within said first portion; and a piston movable axially in said valve portion and connected by a piston rod through said chamber wall to said pressure control diaphragm to be moved thereby, said piston sealingly engaging the walls of said valve portion and in a first position blocking communication between a first one of said outlet ports and opening communication between said inlet port and a second of said outlet ports when the first portion of the control portion is pressurized and in a second position blocking said second outlet portion and communicating said inlet with said first outlet port when the first portion of the control portion is not pressurized.

3. A refrigerator condenser head pressure control as defined in claim 2, further characterized by said inlet port having pressure equalization means communicating it with said first outlet port and operative when the piston is in its first position.

4. A method of providing a constant condenser pressure head in a refrigeration system of the vapor compression type comprising the steps of:

driving a refrigerant through a closed refrigeration circuit;

at a first point in said circuit compressing hot vapor in a refrigerant compressor to add heat of compression and directing the compressed vapor in a stream at a variable pressure through the circuit, at a second point in said circuit directing the heated vapor stream to a condenser to liquify the stream, selectively diverting the heated vapor stream to the gravitational top of a vapor condenser unit when vapor pressure from the compressor is low and selectively diverting the heated vapor stream to the gravitational bottom of the vapor condenser unit and bubbling it upwardly through the condenser to maintain the condensing temperatures at a uniform level when vapor pressure from the compressor is high; and successively directing the liquified refrigerant through the circuit for expansion and evaporation.

* * * * *